US006119880A

United States Patent [19]

Dueck

[11] Patent Number: 6,119,880

[45] **Date of Patent: *Sep. 19, 2000**

[54] SHELF CAROUSEL

[76] Inventor: Raymond Dueck, Box 700, Arborg, Canada, R0C 0A0

[ * ] Notice: This patent issued on a continued prosecution application filed under 37 CFR 1.53(d), and is subject to the twenty year patent term provisions of 35 U.S.C. 154(a)(2).

[21] Appl. No.: 08/824,243

[22] Filed: Mar. 25, 1997

[51] Int. Cl.[7] ..... A47F 5/02

[52] U.S. Cl. ..... 211/121; 312/268; 198/798

[58] Field of Search ..... 211/121; 312/268, 312/34, 136, 97; 198/797, 800

[56] References Cited

U.S. PATENT DOCUMENTS

| | | | |
|---|---|---|---|
| 793,243 | 6/1905 | Symes | 211/121 |
| 1,787,898 | 1/1931 | Fuller | 211/121 |
| 2,030,741 | 2/1936 | Bodine | 211/121 |
| 2,603,547 | 7/1952 | Zook | 211/121 X |
| 2,703,643 | 3/1955 | Parsons | 211/121 X |
| 2,912,118 | 11/1959 | Behrens et al. | 211/121 |
| 3,199,658 | 8/1965 | Graber et al. | 211/121 |
| 3,426,912 | 2/1969 | Perini | 211/121 |
| 4,314,647 | 2/1982 | Harris et al. | 211/121 |
| 5,431,493 | 7/1995 | Larson | 211/121 X |

*Primary Examiner*—Daniel P. Stodola
*Assistant Examiner*—Khoa Tran
*Attorney, Agent, or Firm*—Adrian D. Battison; Murray E. Thrift

[57] ABSTRACT

The shelf carousel comprises an upright support frame, guide tracks arranged on the support frame, shelves arranged for movement along the guide tracks, a shelf stabilizer track fixed adjacent the top end of the guide tracks, a shelf stabilizing member fixed to the shelf, and drive chains connected to the shelves for providing movement along the guide tracks. The guide track includes an upper track portion and a lower track portion. The lower track portion is wider than an upper track portion and lies out of line of the upper track portion. Shelves moving on the lower track portion move out of line with each other and towards the user as the shelves pass the user. The stabilizing track and shelf stabilizing member help reduce tipping or swinging of the shelves as the shelves move through the turn at the top of the guide track.

2 Claims, 5 Drawing Sheets

SHELF CAROUSEL

FIELD OF THE INVENTION

The present invention relates to storage shelves, particularly of the type including a powered carousel for moving the shelves along a track.

BACKGROUND

Storage and display shelves which are mounted on a powered carousel to allow a user to selectively position a shelf within easy reach or within view are known. These devices generally mount the shelves on tracks arranged at either end of the shelf and provide a drive means such as a powered cable or chain for driving the shelves around the tracks. An actuating means is usually provided which allows a user to move the shelves around the track until a desired shelf comes within reach or view.

Large vertical shelf carousels of this type are known for use in industrial applications. Having the shelves mounted on the carousel enables an individual to access all of the shelves without the use of a ladder or other elevating device, and provides a large number of shelves for a given square footage of floor space. To further increase the efficiency of these devices the shelves are generally spaced along the drive means in close proximity to one another so that the bottom of an upper shelf lies close to the top of the lower shelf. This can lead to difficulty in gaining access to an object on the shelf, particularly when the object is nearly as large as the space between the shelves. A second problem associated with these shelves is that since the shelves must be able to travel in a loop about a vertical frame, a turn in the track is necessary at both the top and bottom of the carousel. As a shelf moves through a turn there can be a tendency for the shelf to swing or tip. This may result in an item falling off the shelf which is dangerous and can lead to serious injury. This is particularly true for shelves used to store heavy items.

SUMMARY

According to the present invention there is provided a shelf carousel comprising:

an upright support frame including an upright first frame end and an upright second frame end, said second frame end being spaced from the first frame end;

a pair of guide tracks one being arranged on each of the first and second frame ends, each guide track including a pair of substantially vertical spaced apart track sections and a curved top section connecting the spaced apart track sections;

at least one shelf arranged for movement along the guide tracks, said at least one shelf having a first end and a second end, the first end being arranged to lie adjacent the first frame end, and the second end being arranged to lie adjacent the second frame end;

a pair of guide track followers one being fixed to each of the first and second ends of the at least one shelf, each guide track follower being arranged to engage a respective one of the pair guide tracks for movement therealong;

a shelf stabilizing track fixed to at least one of the first and second upright frame ends, and being spaced outwards from and arranged around the top section of the guide track;

a shelf stabilizing member fixed to at least one of the ends of the at least one shelf and arranged adjacent the shelf stabilizing track and substantially perpendicular to a longitudinal axis of said at least one shelf;

drive means connected to the at least one shelf for providing movement along the guide tracks;

and actuating means for selectively actuating the drive means;

and wherein the stabilizing member is sized and arranged to engage the stabilizing track when the at least one shelf travels on the curved top section of the guide track from a first one of the substantially vertical spaced apart track sections to a second one of the substantially vertical spaced apart track sections.

According to a second aspect of the present invention there is provided a shelf carousel comprising:

an upright support frame including an upright first frame end and an upright second frame end, said second frame end being spaced from the first frame end;

a pair of guide tracks one being arranged on each of the first and second frame ends, each guide track including:

an upper guide track portion comprising a substantially vertical first track section having a top end and a bottom end, a substantially vertical second track section spaced from the first track section and having a top end and a bottom end, and a curved track section arranged to extend from the top end of the first track section to the top end of the second track section;

a lower guide track portion having a first end connected to the bottom end of the first track section of the upper track portion, and a second end connected to the bottom end of the second track section of the upper track portion, and wherein the lower guide track portion is wider than the upper track portion extending laterally outwards from the upper track portion;

at least one shelf arranged for movement along the guide tracks, said at least one shelf having a first end and a second end, the first end being arranged to lie adjacent the first frame end, and the second end being arranged to lie adjacent the second frame end;

a pair of guide track followers one being fixed to each of the first and second ends of the at least one shelf, each guide track follower being arranged to engage a respective one of the pair of guide tracks for movement thereon;

drive means connected to the at least one shelf for providing movement along the guide tracks;

and actuating means for selectively actuating the drive means.

The guide track may include a plurality of upper guide track portions arranged side by side.

BRIEF DESCRIPTION OF THE DRAWINGS

In the accompanying drawings, which illustrate an exemplary embodiment of the present invention.

DETAILED DESCRIPTION

Figure 1:
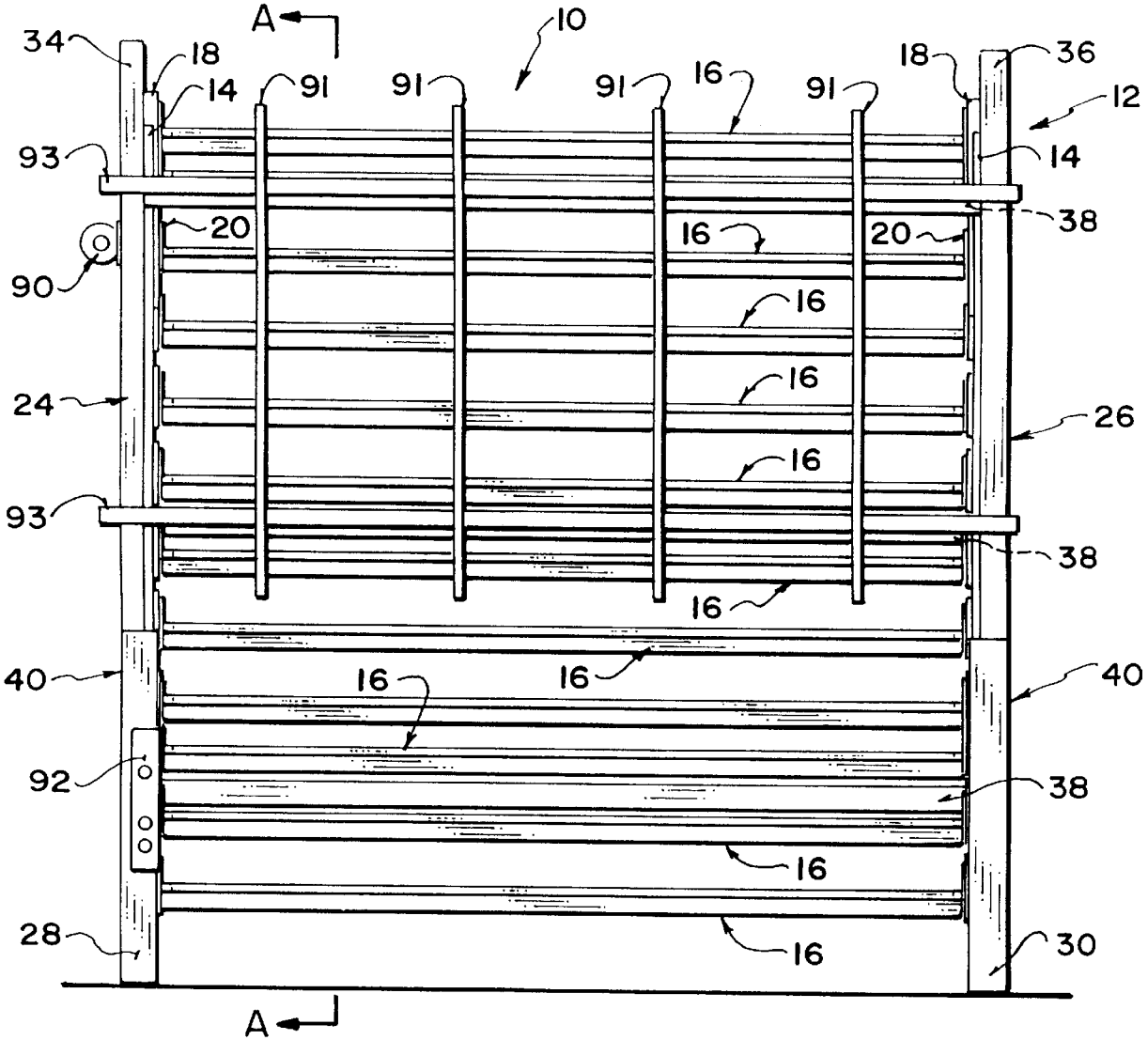
FIG. 1 is a front view of the shelf carousel.
Figure 2:
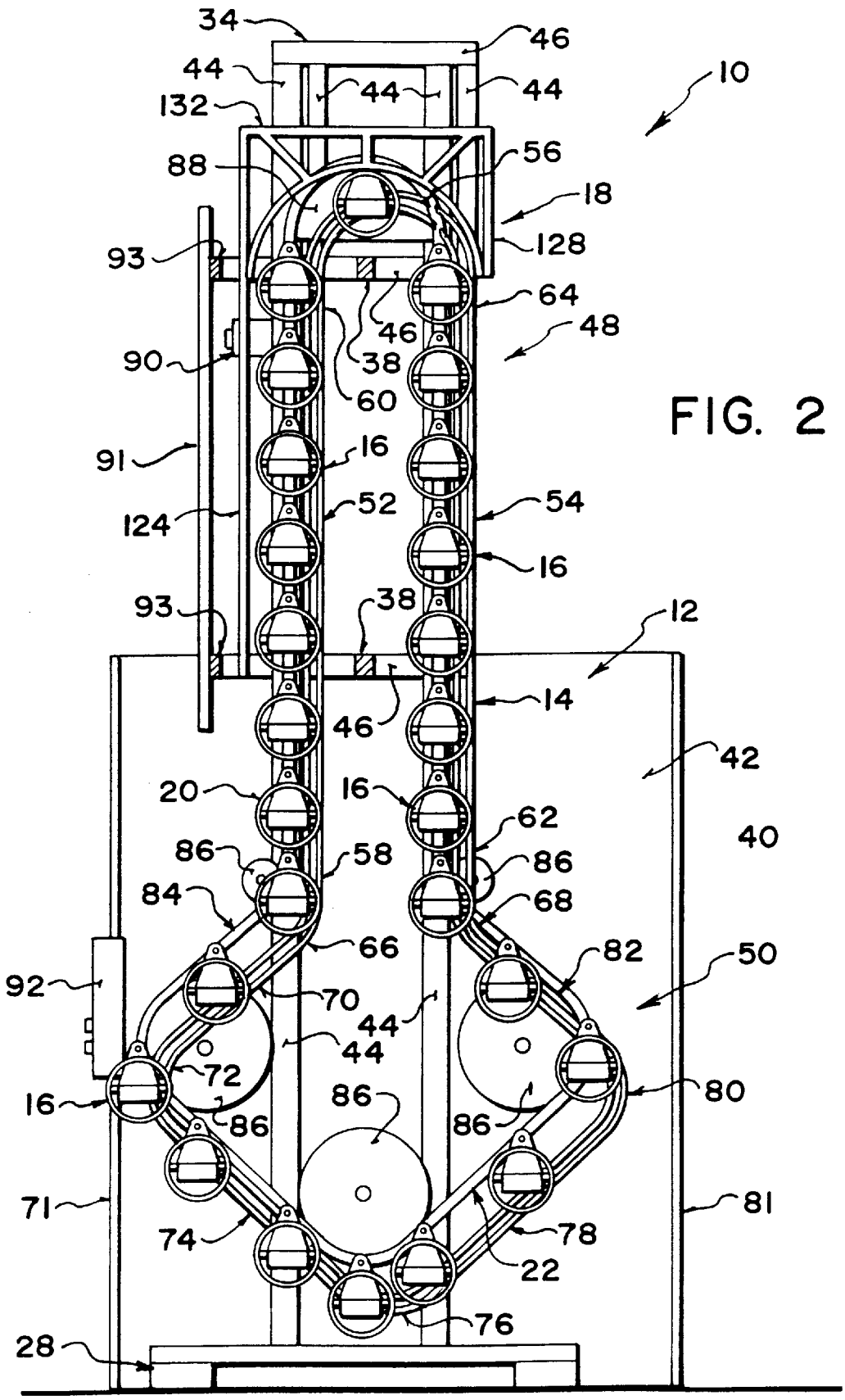
FIG. 2 is a view of the shelf carousel through lines A—A of FIG. 1.
Figure 3:
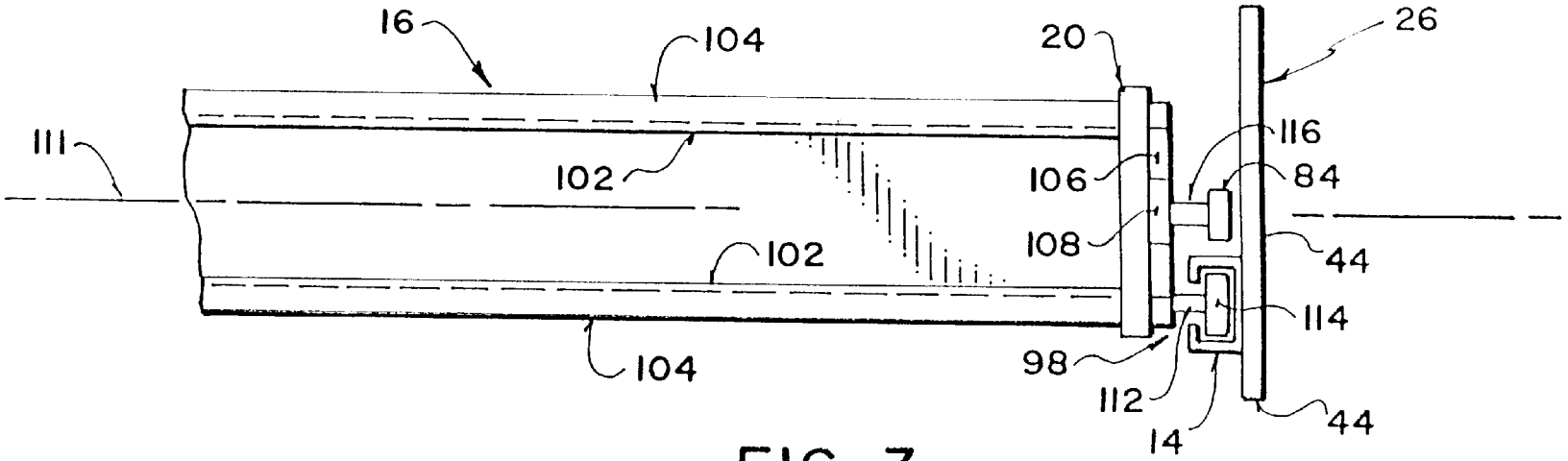
FIG. 3 is a top view of the one end of one of the shelves.
Figure 4:
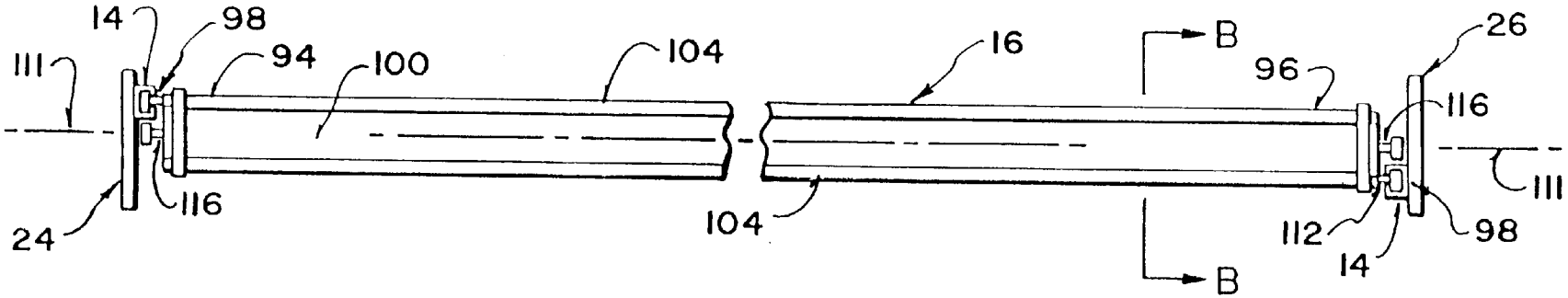
FIG. 4 is a top view of one of the shelves.
Figure 6:
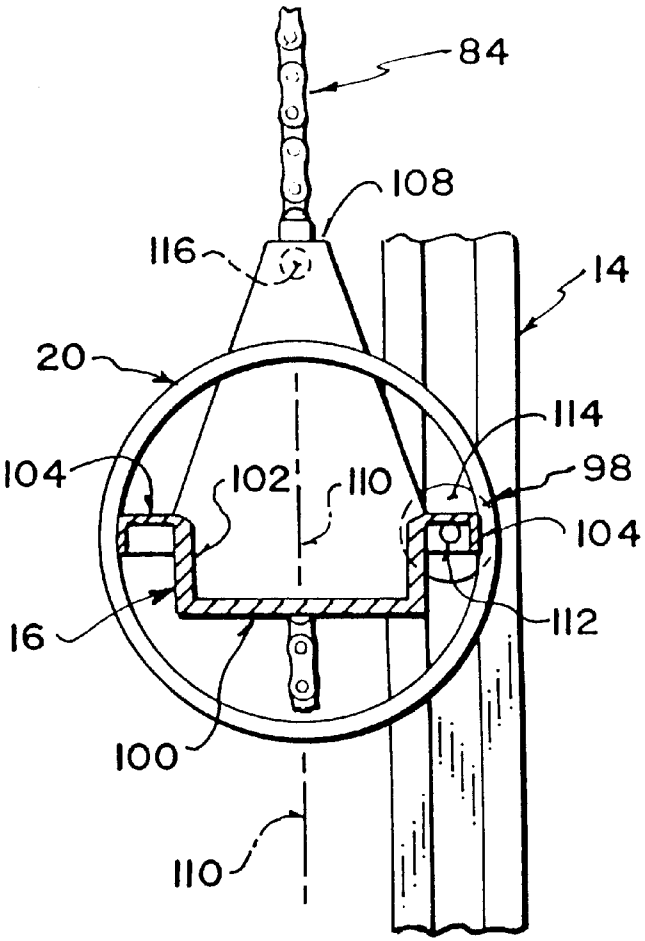
FIG. 6 is an end view of one of the shelves through line B—B of FIG. 4.
Figure 5:
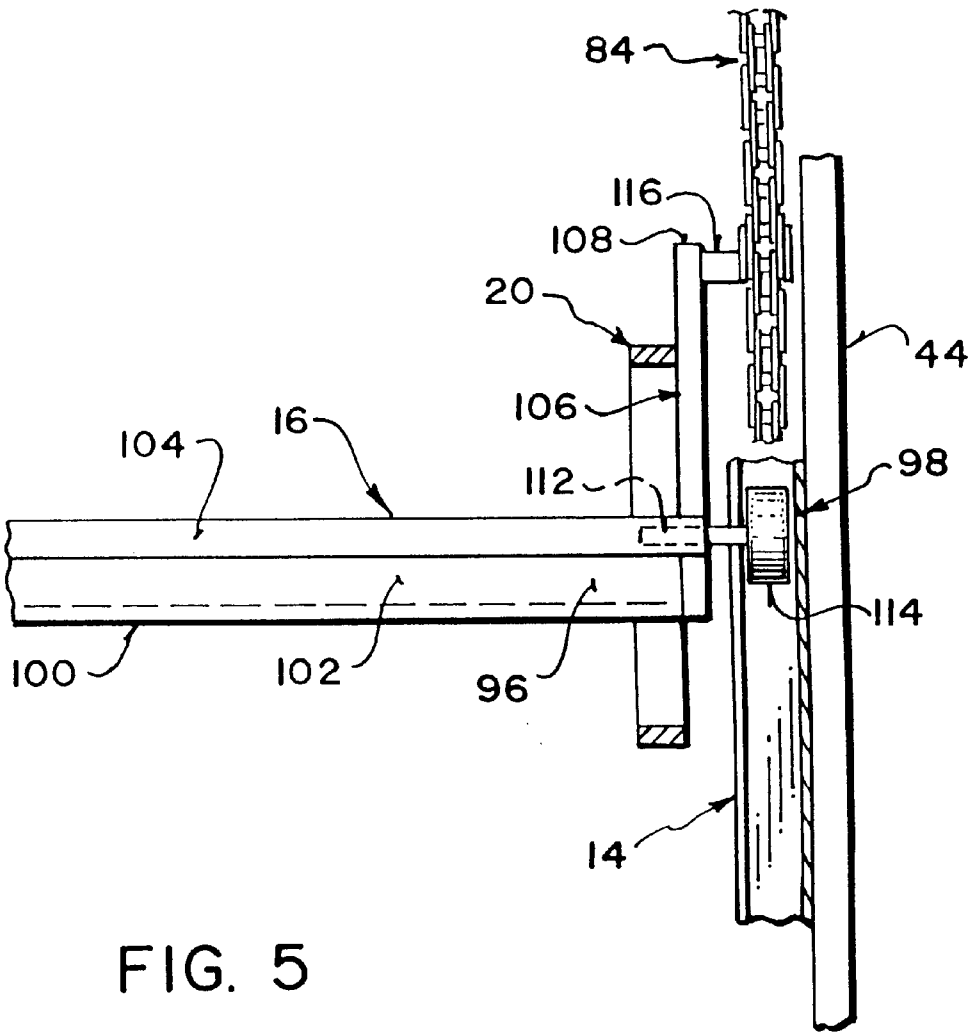
FIG. 5 is a side view of one end of one of the shelves showing the stabilizing member, cam follower, and track.

Referring to FIGS. 1 and 2 the shelf carousel is shown generally at 10. The shelf carousel 10 comprises an upright support frame 12 guide tracks 14 arranged on the support frame 12, shelves 16 arranged for movement along the guide tracks 14, a shelf stabilizer track 18 fixed adjacent the top end of the guide tracks 14, a shelf stabilizing member 20 fixed to each shelf 16, and drive means 22 connected to the shelves 16 for providing movement along the guide tracks 14.

The upright support frame 12 comprises a first and second upright end frame 24 and 26 which are spaced apart from one another and are arranged such that their respective bottom ends 28 and 30 lie in contact with a supporting surface and extend upwards therefrom to respective top ends 34 and 36. One or more longitudinal support members 38 extend between the upright first and second end frames 24 and 26 holding them in the upright position. Each of the first and second upright end frames 24 and 26 are identical and are interchangeable with one another. This simplifies manufacture of the shelf carousel 10.

Each upright end frame 24 and 26 includes a lower portion 40 which has an enclosing wall 42. The enclosing wall 42 extends laterally of the end frame and encloses the drive means 22 and guide tracks 14. The enclosing wall 42 protects individuals from contact with the moving parts of the shelf carousel 10 when it is in use.

Extending upwards from the lower portion 40 of each end frame 24 and 26 is a plurality of upright support members 44. The upright support members 44 support the guide track 14, the stabilizing track 18, and the drive means 22. Cross members 46 extend between the upright support members 44 at a number of locations spaced along the length thereof, thereby strengthening the frame 12.

On each of the upright first and second end frames 24 and 26 is mounted a guide track 14. The guide track 14 comprises an upper guide track portion 48 and a lower guide track portion 50. The upper guide track portion 48 comprises a substantially vertical first track section 52, a substantially vertical second track section 54, and a curved track section 56. The substantially vertical first track section 52 extends from a bottom end 58 to a top end 60, and the substantially vertical second track section 54 extends from a bottom end 62 to a top end 64. The curved track section 56 extends from the top end 60 of the first track section 52 to the top end 64 of the second track 54. The curved track section 56 allows shelves to move between the first track section 52 and the second track section 54. The upper guide track portion 48 is supported by the upright support members 44.

The lower track portion 50 extends between a first end 66, and a second end 68. The first end 66 of the lower track portion 50 is connected to the bottom end 58 of the first track section 52 of the upper track portion 48. The second end 68 of the lower guide track portion 50 is connected to the bottom end 62 of the second track section 54 of the upper track portion 48. The lower track portion 50 projects outwards from the upper track portion 48 and is substantially diamond shaped having a first track section 70 extending from the first end 66 downwards and outwards to a corner 72 adjacent a first side 71 of the enclosing wall 42, and a second track section 74 extending downwards and inwards to a corner 76 arranged adjacent the bottom of the end frame 24 or 26. A third track section 78 of the lower guide track portion 50 extends upwards and outwards in a direction away from the second track section 74 from the corner 76 to a corner 80 arranged adjacent a second side 81 of the enclosing wall 42 and opposite the side 71. A fourth track section 82 extends upwards and inwards from the corner 80 to the second end 68.

The arrangement of the guide track 14 on the first end frame 24 is the same as the arrangement of the guide track 14 on the second end frame 26. This enables the first and second end frames to be used interchangeably.

The drive means 22 are connected to each of the shelves 16 and provide for movement of the shelves 16 along the guide track 14. The drive means 22 are provided by a chain 84 which is arranged to follow the guide track 14 on the first end frame 24 and is offset from the guide track 14 such that the chain 84 is spaced upwards and to one side of the guide track 14. The motion of the chain 84 is controlled by a number of sprockets 86 which are arranged along the length of the chain 84 and by a guide member 88 arranged adjacent the top of the upright frame 24. An electric motor 90 drives the chain 84 over the sprockets 86, the guide member 88, and around the track 14. Actuating means 92 are provided for controlling the movement of the chain 84 allowing the operator to selectively reposition a shelf or shelves 16 into a desired location.

A plurality of upright members 91 are provided to prevent items from falling off the shelves 16. The upright members 91 are fixed to the outside of the carousel 10 and are spaced apart along the length of the shelves 16 and are connected to the frame ends 24 and 26 by a pair of cross members 93. Each of the cross members 93 is fixed at each of its ends to a respective one of the first and second frame ends 24 and 26.

Referring to FIGS. 2 to 6 the shelves 16 are arranged to extend between the first end frame 24 and the second end frame 26. Each shelf 16 has a first end 94 and a second end 96 and is arranged such that the first end 94 lies adjacent the first end frame 24 and the second end 96 lies adjacent the second end frame 26. A shelf bottom 100 extends longitudinally along the shelf 16 between the first end 94 and the second end 96. A pair of side walls 102 extending longitudinally along the shelf bottom 100 and project upwards from the shelf bottom 100. A reinforcing channel 104 extends along the length of each side wall 102, adjacent a top end of each side wall 102 and along an outer face thereof. An end plate 106 is mounted at each of the ends 94 and 96 of the shelf 16 and extends upwards from the shelf 16 to a tapered top end 108.

One guide track follower 98 is fixed to the shelf 16 at each of the first and second ends 94 and 96 of the shelf 16. The guide track follower 98 are arranged to engage respective guide tracks 14 mounted on the first and second upright end frames 24 and 26, and are arranged for movement therealong. The guide track followers 98 each comprise an axle 112 mounted on the shelf 16 within the reinforcing channel 104 and extending parallel to a longitudinal axis 111 of the shelf 16, and a roller 114 rotatably mounted on the axle 112. The roller 114 engages within the guide track 14 such that it is constrained to move along the track 14 as the shelf 16 is moved by the drive means 22.

The guide track followers 98 are fixed to the shelves at opposite ends 94 and 96 of the shelf 16 and are diagonally opposed to one another, such that the guide track follower 98 at the first end 94 of the shelf is arranged on one side of the shelf 16 and the guide track follower 98 at the second end 96 of the shelf 16 is arranged on a side opposite. Having the guide track followers 98 mounted on opposite sides of the shelf 16 provides greater stability to the shelf 16 and helps prevent the shelf 16 from tipping or rotating. Each shelf 16 is connected to the drive means 22 by a connection member 116 extending from the end plate 106 adjacent the top end 108 thereof. The connection member 116 is arranged above and spaced from each of the guide track followers 98 and lies above a longitudinal centre line 110 of the shelf bottom 100. The end plate 106 is fixed by the connection member 116 to the chain 84 and thus is compelled to follow the chain 84 as the chain 84 is moved by the motor 90 around the guide track 14.

As the shelf 16 travels around the guide track 14 to the top end of the guide track 14 it passes from the first vertical track section 52 across the curved track section 56 to the second vertical track section 54. This change in direction of the shelf 16 tends to cause the shelf 16 to swing about the connection member 116. This can be a significant problem if the shelf 16 is carrying a heavy item and/or if the items on the shelf 16 are not centered on the shelf 16. If the shelf 16 swings or twists items on the shelf 16 can fall off posing a serious hazard to a person operating the carousel or to passersby. Mounting the guide track followers 98 at positions spaced downwards from the connection member 116 helps provide stability to the shelf 16 and reduces the tendency of the shelf 16 to swing or twist.

Figure 7:
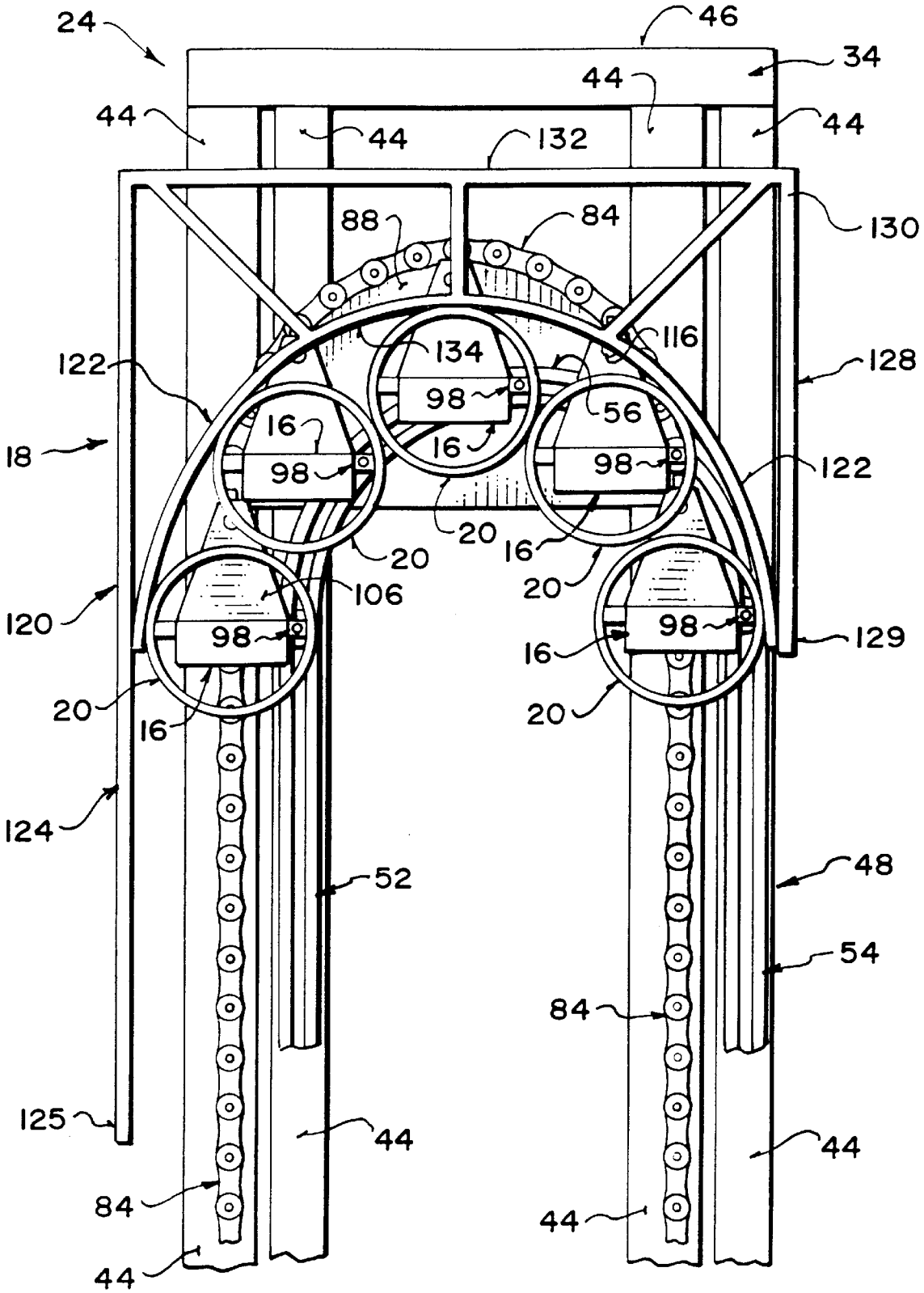
FIG. 7 is a side view of the stabilizing track.

Referring to FIGS. 2 and 7 the shelf stabilizing track 18 is arranged adjacent the top of the upper track portion 48 to ensure that the shelf 16 remains stable and cannot swing or twist as the shelf 16 moves along the curved track section 56 of the upper track portion 48. The shelf stabilizing track 18 comprises a track support frame 120 and a curved track 122. The track support frame 120 is fixed to the carousel 10 and has a substantially vertical first support member 124 having a first end 125 arranged adjacent and spaced laterally outwards of the first track section 52 of the guide track 14 and a second end 126 arranged above the guide track 14, and a substantially vertical second support member 128 having a first end 129 arranged adjacent and spaced laterally outwards of the second track section 54 of the guide track 14 and a second end 130 arranged above the guide track 14. A cross member 132 extends from the second end 126 of the first support member 124 to the second end 130 of the second support member 128. The curved track 122 extends from the first support member 124 to the second member 128 and is shaped to follow the path of the shelf stabilizing members 20 as the shelves 16 move along the upper portion 56 of the guide track 14. The stabilizing track 18 has a contact surface 134 facing downwards towards the shelves 16 and shelf stabilizing members 20 which lie below. The contact surface 134 extends along the curved track 122 and is arranged to engage the shelf stabilizing members 20.

Referring to FIG. 7 each shelf has a shelf stabilizing member 20 for engaging the stabilizing track 18 which helps prevent shelves 16 from twisting or dumping as they move around the curved track section 56 of the guide track 14. The shelf stabilizing member 20 is fixed to each shelf 16 at least one of the ends 94 and 96 of the shelf 16 and projects outwards from the shelf perpendicular to the longitudinal axis 111 of the shelf 16. The shelf stabilizing member 20 is circular in shape and is arranged around the end of the shelf 16. The shelf stabilizing members 20 are sized and arranged to engage the contact surface 134 of the stabilizing track 18 and adjacent stabilizing members 20 as the shelf 16 travels on the guide track 14 along the curved track section 56 from a first one of the substantially vertical spaced apart track sections 52 to the second one of the substantially vertical spaced apart track sections 54. This contact holds the shelf 16 in place preventing it from tipping and forces the shelf 20 around the curved track section 56 of the guide track 14 even if the guide members 98 come free from the guide track 14

In use an individual wishing to recover an item stored on one of the shelves 16 on the shelf carousel 10 actuates the drive actuating means 92. This causes the drive means 22 to move the shelves 16 around the guide track 14 and past the user. As the shelves 16 travel around the guide track 14 they travel over the lower guide track 50. The lower guide track 50 being wider then the upper track portion 48 brings the shelves out of line with each other and out of line with the upper track portion 48. Having the shelf 16 travel outwards towards the user and out of line of the upper track portion 48 brings each individual shelf into clear view as it passes the operator and allows for easy access to the shelf without interference from shelves arranged above the desired shelf. When the shelf containing the item desired is positioned out of line with the other shelves on the lower track portion 50 the operator deactuates the drive means 22 stopping movement of the shelf clear of any shelves above it. The desired item may then be retrieved from the shelf 16 or additional items may be added to the shelf.

In one alternative embodiment the shelf carousel 10 may include a shelf stabilizing track 18 arranged at each of the first and second upright end frames 24 and 26 and a shelf stabilizing member 20 fixed to each of the ends 94 and 96 of each shelf 16.

While one embodiment of the present invention has been described in the foregoing, it is to be understood that other embodiments are possible within the scope of the invention. The invention is to be considered limited solely by the scope of the appended claims.

What is claimed is:

1. A shelf carousel comprising:

an upright support frame including an upright first frame end and an upright second frame end, said second frame end being spaced from the first frame end;

a pair of guide tracks, each being arranged on a respective one of the first and second frame ends, each guide track including a pair of spaced apart track sections each of which extends vertically and a curved top track section connecting the spaced apart track sections;

a pair of endless drive chains, each being arranged on a respective one of the first and second frame ends and each including a pair of spaced apart chain sections each of which extends vertically and a curved top chain section connecting the spaced apart chain sections;

a plurality of shelves mounted on the drive chains for movement therewith, each shelf having a first end carried on the drive chain of the first frame end, and a second end carried on the drive chain of the second frame end;

each shelf being mounted on the drive chains for movement therewith so that the shelf remains horizontal as it moves with the endless drive chains;

each shelf having thereon a pair of guide track followers, each arranged at a respective end of the shelf, each guide track follower being arranged to engage a respective one of the pair of guide tracks for movement therealong;

an arcuate shelf stabilizing track fixed and stationary relative to at least one of the first and second upright frame ends, the arcuate shelf stabilizing track being separated from the guide track;

each shelf having at least one end plate with a circular ring member fixed to the end plate of the shelf adjacent the shelf stabilizing track, the circular ring member surrounding the end of the shelf and arranged to engage the shelf stabilizing track, the circular ring member being separated from the track follower of the shelf which is at the end of the shelf adjacent the shelf stabilizing track;

the circular ring member having a circular outer surface which remains in direct engagement with the arcuate stabilizing track as the at least one shelf travels with the guide track follower thereof as the shelf and the ring member move relative to the curved top section of the stationary guide track from a first one of the spaced apart track sections to a second one of the spaced apart track sections.

2. A shelf carousel comprising:

an upright support frame including an upright first frame end and an upright second frame end, said second frame end being spaced from the first frame end;

a pair of guide tracks, each being arranged on a respective one of the first and second frame ends, each guide track including a pair of spaced apart track sections each of which extends vertically and a curved top track section connecting the spaced apart track sections;

a pair of endless drive chains, each being arranged on a respective one of the first and second frame ends and each including a pair of spaced apart chain sections and a curved top chain section connecting the spaced apart chain sections;

a plurality of shelves mounted on the drive chains for movement therewith, each shelf having a first end carried on the drive chain of the first frame end, and a second end carried on the drive chain of the second frame end;

each shelf being mounted on the drive chains for movement therewith so that the shelf remains horizontal as it moves with the endless drive chains;

each shelf having thereon a pair of guide track followers, each arranged at a respective end of the shelf, each guide track follower being arranged to engage a respective one of the pair of guide tracks for movement therealong;

an arcuate shelf stabilizing track fixed and stationary relative to at least one of the first and second upright frame ends, the arcuate shelf stabilizing track being separated from the guide track;

each shelf having at least one end plate with a circular ring member fixed to the end plate of the shelf adjacent the shelf stabilizing track, the circular ring member surrounding the end of the shelf and arranged to engage the shelf stabilizing track, the circular ring member being separated from the track follower of the shelf which is at the end of the shelf adjacent the shelf stabilizing track;

the circular ring member having a circular outer surface which remains in direct engagement with the arcuate stabilizing track as the at least one shelf travels with the guide track follower thereof as the shelf and the ring member move relative to the curved top section of the stationary guide track from a first one of the spaced apart track sections to a second one of the spaced apart track sections;

each shelf having a front edge for facing forwardly toward a user and a rear edge opposite to the front edge for facing rearwardly away from a user;

the guide track follower on a first end of the shelf adjacent the first frame end consisting solely of a single guide track follower only which single guide track follower is arranged offset from a center line of the shelf toward the front edge of the shelf;

the guide track follower on a second end of the shelf adjacent the second frame end consisting solely of a single guide track follower only which single guide track follower is arranged offset from the center line of the shelf toward the rear edge of the shelf.

* * * * *